US006150805A

United States Patent [19]

Rapp

[11] Patent Number: 6,150,805

[45] Date of Patent: Nov. 21, 2000

[54] SELF-CANCELING START-UP PULSE GENERATOR

[75] Inventor: A. Karl Rapp, Los Gatos, Calif.

[73] Assignee: Fairchild Semiconductor Corporation, So. Portland, Me.

[21] Appl. No.: 09/186,918

[22] Filed: Nov. 6, 1998

[51] Int. Cl.[7] ..... G05F 3/26

[52] U.S. Cl. ..... 323/315; 323/901

[58] Field of Search ..... 323/312, 313, 323/314, 315, 316, 901

[56] References Cited

U.S. PATENT DOCUMENTS 4,563,733 1/1986 Schlenk ..... 323/901
5,686,824 11/1997 Rapp ..... 323/313
5,751,142 5/1998 Dosho et al. ..... 323/316
5,867,013 2/1999 Yu ..... 323/314
5,949,227 9/1999 Bujanos ..... 323/313

*Primary Examiner*—Jeffrey Sterrett
*Attorney, Agent, or Firm*—Skjerven, Morrill, MacPherson, Franklin & Friel LLP; Norman R. Klivans

[57] ABSTRACT

A method and circuits for generating a start-up signal to force a bistable reference circuit into a conducting state. The start-up signal ensures that the reference circuit operates to provide a desired output signal when power is applied. The start-up signal is self-generated and self-canceled, rather than relying on an externally supplied pulse, and is input to the reference circuit via a hysteresis circuit (e.g., Schmitt inverter).

10 Claims, 4 Drawing Sheets

M1715
10/1
M1714
3/25
M1702
5/5
116
102
M1643
5/5
M1642
25/5
50k
R1652
M1632
100/3
M1633
25/5
M1750
50/1
M1748
3/3
M1749
5/5
M1630
6/3
$P_{REF}$
M1631
5/5
M1629
5/5
M1651
5/5
M1628
20/5
$V_{RAW}$

Key To

SELF-CANCELING START-UP PULSE GENERATOR

BACKGROUND

1. Field of Invention

The present invention relates generally to current or voltage reference generating circuits. More particularly, it relates to a circuit and method for generating a start-up pulse for such reference circuits.

2. Description of Related Art

Many integrated circuits use reference generating circuits to provide stable current or voltage references. Current mirror reference generating circuits are known in the art. A circuit with one or more current mirrors is configured to seek its own current, thereby creating a current source independent of temperature and circuit processes. A problem with many circuit configurations is that they may settle in one of two steady states upon initial power-up. In one steady state the circuit conducts to provide its design value reference output. In a second steady state, however, the circuit remains in a non-conducting state and does not provide the desired reference output.

To overcome the problem of a non-conducting current steady state on initial power-up, many circuits use an initial start-up pulse to force the reference generating circuit into its desired operating state. Existing circuits require this start-up pulse to be from an external source such as a system-wide central processing unit (CPU). However, some integrated circuit devices must operate independently of any direct external power source.

One example is a remote radio frequency identification circuit. These remotely powered integrated circuits cannot access any externally applied start-up pulse used to force the reference generating circuit to a conducting state. Further, other on-chip systems such as a CPU are also in indeterminate states on initial power-up and so cannot be relied upon to provide the needed start-up pulse. Therefore the need exists for a circuit that reliably generates the required start-up pulse within the integrated circuit itself.

A related concern for independently operating integrated circuits is to minimize power consumption. If no start-up pulse is required, for example, no power need be used to supply one. Similarly, once the reference circuit receives a required start-up pulse, the pulse generating circuit should be turned off. Therefore a circuit that provides a start-up pulse only when required, and minimizes current drain after providing the pulse, is desirable.

SUMMARY

The invention is directed to a method, and to electrical circuits for carrying out the method, for providing a start-up signal to a reference circuit. The start-up signal ensures the reference circuit operates to provide a desired output signal when power is applied. The method and circuits allow the start-up signal to be self-generated and self-canceled, rather than relying on an externally supplied pulse. Moreover, the start up pulse is automatically generated if at any time the circuit is disturbed and assumes its zero current state.

A monitor (e.g., a current monitor) receives a signal indicating e.g. a current level in a reference circuit. The monitor also provides information to a start-up signal generator. The start-up signal generator can supply a start-up signal to the reference circuit to ensure the reference circuit settles in its conducting steady state.

When the monitor receives a signal indicating that reference circuit current is below a desired level, such as when electric power is first supplied to the reference circuit, it acts to provide a required start-up signal via the start-up signal generator. When the monitor senses that the reference circuit is operating properly, it acts to turn off the start-up signal. In some embodiments, the start-up signal generator is controlled via intermediate circuit elements such as inverters or inverters with hysteresis (Schmitt inverters). In some embodiments, weak current sources for circuit elements are turned off when a start-up pulse is not required, thus reducing system power consumption.

DETAILED DESCRIPTION

The description that follows is of embodiments of the invention both in terms of circuit blocks and specific circuit components. The circuit examples use MOSFETs, however those skilled in the art should realize that a variety of electronically controllable switching devices may be used.

Figure 1:
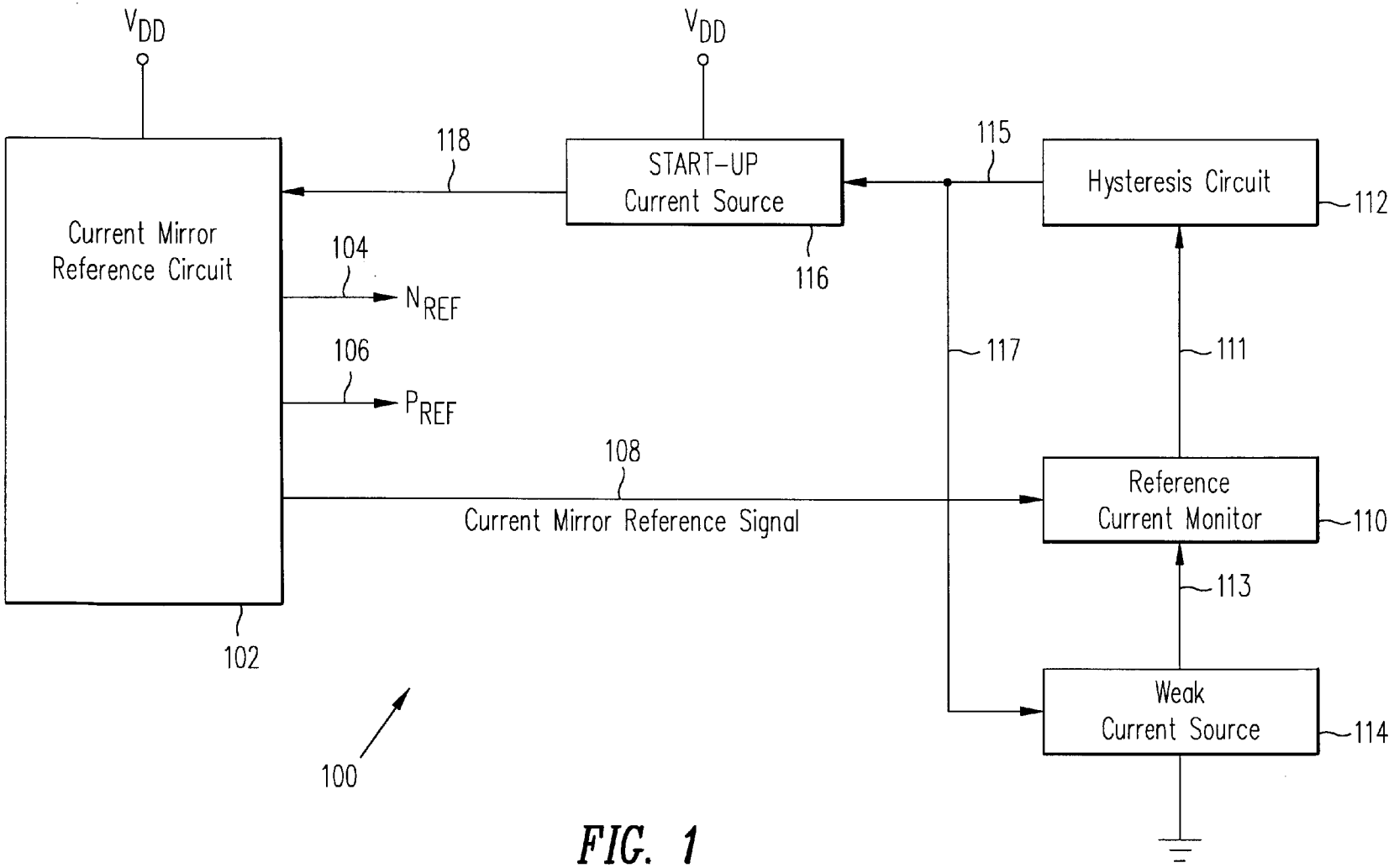
FIG. 1 shows a block diagram of an embodiment of the invention.

FIG. 1 shows a block diagram of self-generating start-up pulse generating system 100. A current mirror reference circuit 102 generates reference outputs $N_{Ref}$ 104 and $P_{Ref}$ 106. A reference current monitor 110 is coupled to reference circuit 102 via line 108, and a current mirror reference signal on line 108 indicates reference circuit 102's conducting state to a reference current monitor 110 input terminal.

A hysteresis circuit 112 has an input terminal coupled to a reference current monitor 110 output terminal via line 111 so that reference current monitor 110 provides an input signal for hysteresis circuit 112. In some embodiments hysteresis circuit 112 may include an inverter (Schmitt inverter). Reference current monitor 110 provides this input signal by way of another terminal coupled to a weak current source 114 via line 113. Current source 114 sources a small current to minimize power consumption and to facilitate overpowering of the current source 114 by the reference current monitor 110, as described below. Hysteresis circuit 112 has its output terminal coupled, via line 115, to start-up current source 116. Start-up current source 116 receives an input signal from hysteresis circuit 112 and, when required, provides a start-up current via line 118 to reference circuit 102.

When voltage $V_{DD}$ is applied and current mirror reference circuit 102 is in a non-conducting steady state, the system 100 self-generates a start-up pulse as follows. The absence of a current-mirror reference voltage on line 108 indicates to reference current monitor 110 that reference circuit 102 is in a non-conducting state. Reference current monitor 110 then fails to overpower the weak current source 114, thus providing a signal that causes the hysteresis circuit 112 to output a signal on line 115. Start-up current source 116 receives the hysteresis circuit 112 output signal on line 115 and in response provides a current via line 118 to force reference circuit 102 into a conducting state. Some embodiments include inverter circuits to provide the correct signal polarity.

Reference circuit 102 provides a current mirror reference signal via line 108 to reference current monitor 110 when reference circuit 102 reaches its conducting state, thus indicating to current monitor 110 that reference circuit 102 is in its conducting state. Current monitor 110 then deactivates start-up current source 116 by providing a signal causing hysteresis circuit 112's output signal to change state, thereby turning off current source 116. Start-up current source 116 thus provides a start-up current pulse when required, based on reference circuit 102's conducting state.

In FIG. 1 weak current source 114 is coupled to receive hysteresis circuit 112's output signal on line 117. This coupling allows the output signal from hysteresis circuit 112 to deactivate weak current source 114 after reference circuit 102 reaches its conducting state, thereby reducing circuit power consumption.

Some embodiments allow weak current source 114 to continuously conduct and not be controlled. These embodiments would ensure restarting if the current mirror reference 102 was inadvertently turned off by noise being coupled into it, for example, thus causing the state of signals to be indeterminate.

Figure 2:
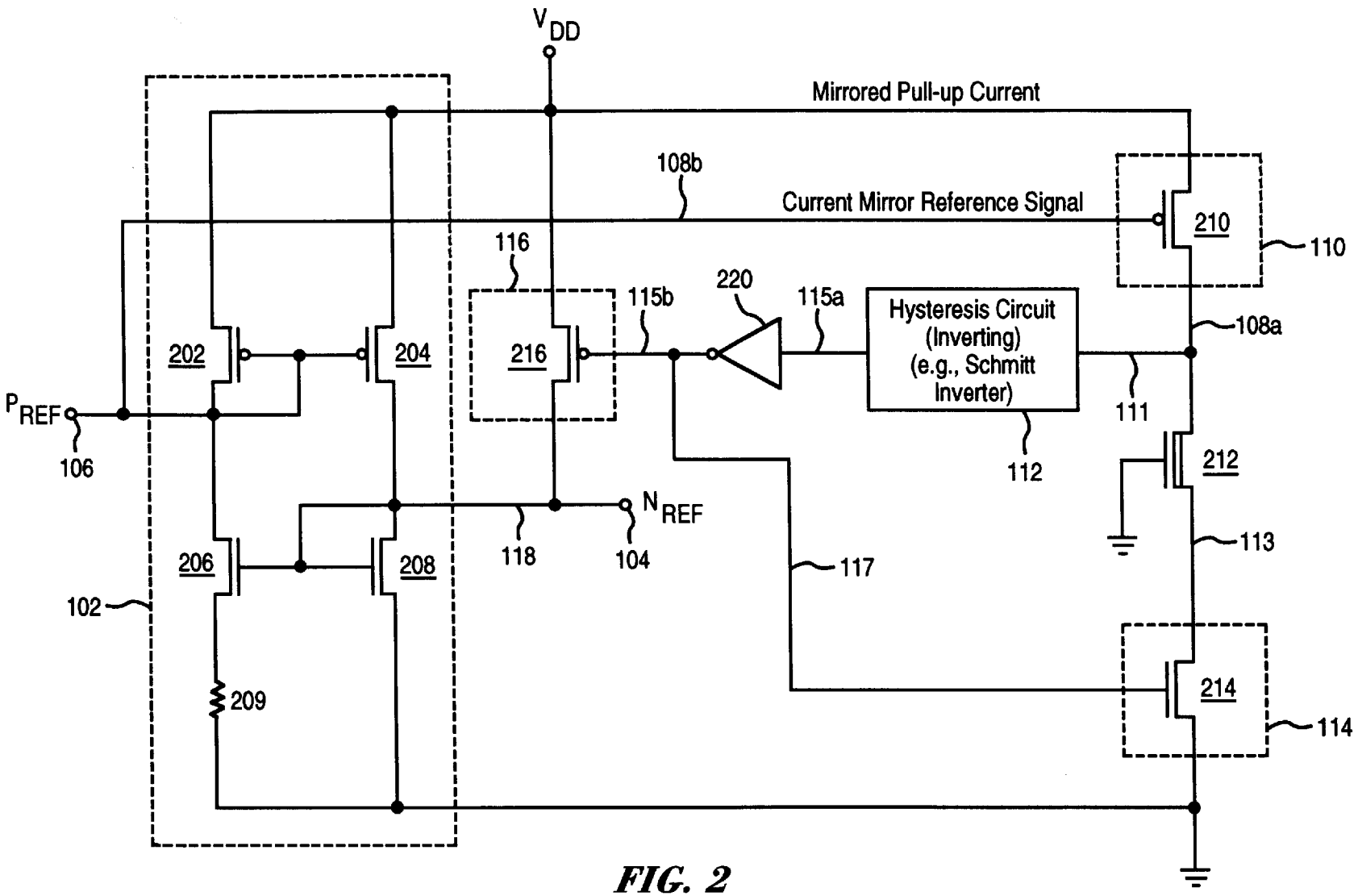
FIG. 2 shows a combination schematic and block diagram illustrating the FIG. 1 embodiment in more detail.

FIG. 2 shows a combination schematic and block diagram of an embodiment of the invention similar to that of FIG. 1 but in more detail. The depiction shows P-type and N-type enhancement and depletion mode MOSFETs using well-known symbols. In this embodiment, low and high voltage levels represent logic states.

A current mirror reference circuit 102 includes transistors 202, 204, 206, 208, and resistor 209. As described above, reference circuit 102 may stabilize in one of two possible steady states at a time after $V_{DD}$ is applied. In its conducting state, transistors 202, 204, 206, and 208 and resistor 209 establish defined currents within their interconnected loop and the circuit provides steady current mirror reference voltages $N_{Ref}$ and $P_{Ref}$ at output terminals 104 and 106 respectively. Current levels are dependent on the transistor dimensions and on the resistor value. If reference circuit 102 operates in a non-conducting state, however, the remaining circuit elements shown act to provide a start-up pulse to force reference circuit 102 into its conducting state.

In the embodiment shown, transistor 210 acts as a reference current monitor and receives the $P_{Ref}$ signal via line 108*b*. When reference circuit 102 operates in an undesired non-conducting state, the $P_{Ref}$ voltage signal reflects the absence of current in transistor 202, causing transistor 210 to not conduct. Weak current source 114 then holds the input signal on line 111 to inverting hysteresis circuit 112 to low voltage. In turn, hysteresis circuit 112 provides a low voltage signal on line 115*b*, thus turning on start-up current transistor 216. The start-up current flows through mirror-connected N-channel transistor 208, reflecting current in transistor 206. The reflected current flows through reference-mirror-connected P-channel transistor 202, thus establishing the $P_{Ref}$ reference voltage. $P_{Ref}$ in turn reflects currents in transistor 204, closing the loop between current mirror reference circuit 102 and current reference monitor 110, thereby turning off or canceling the start-up action. Transistor 212 acts as a capacitor, assisting in holding the voltage on line 111 at ground potential as $V_{DD}$ powers up.

FIG. 2 further shows an embodiment of the invention resulting in low power consumption. Inverting hysteresis inverter circuit 112 outputs a signal on line 117 which via inverter 220 controls transistor 214. As described above, line 117 voltage is set to a logic low level when reference circuit 102 is operating at its conducting state. The logic low voltage level on line 117 turns off transistor 214 and therefore transistor 214 consumes no power when a start-up pulse is unneeded.

Figures 3, 3A, 3B:
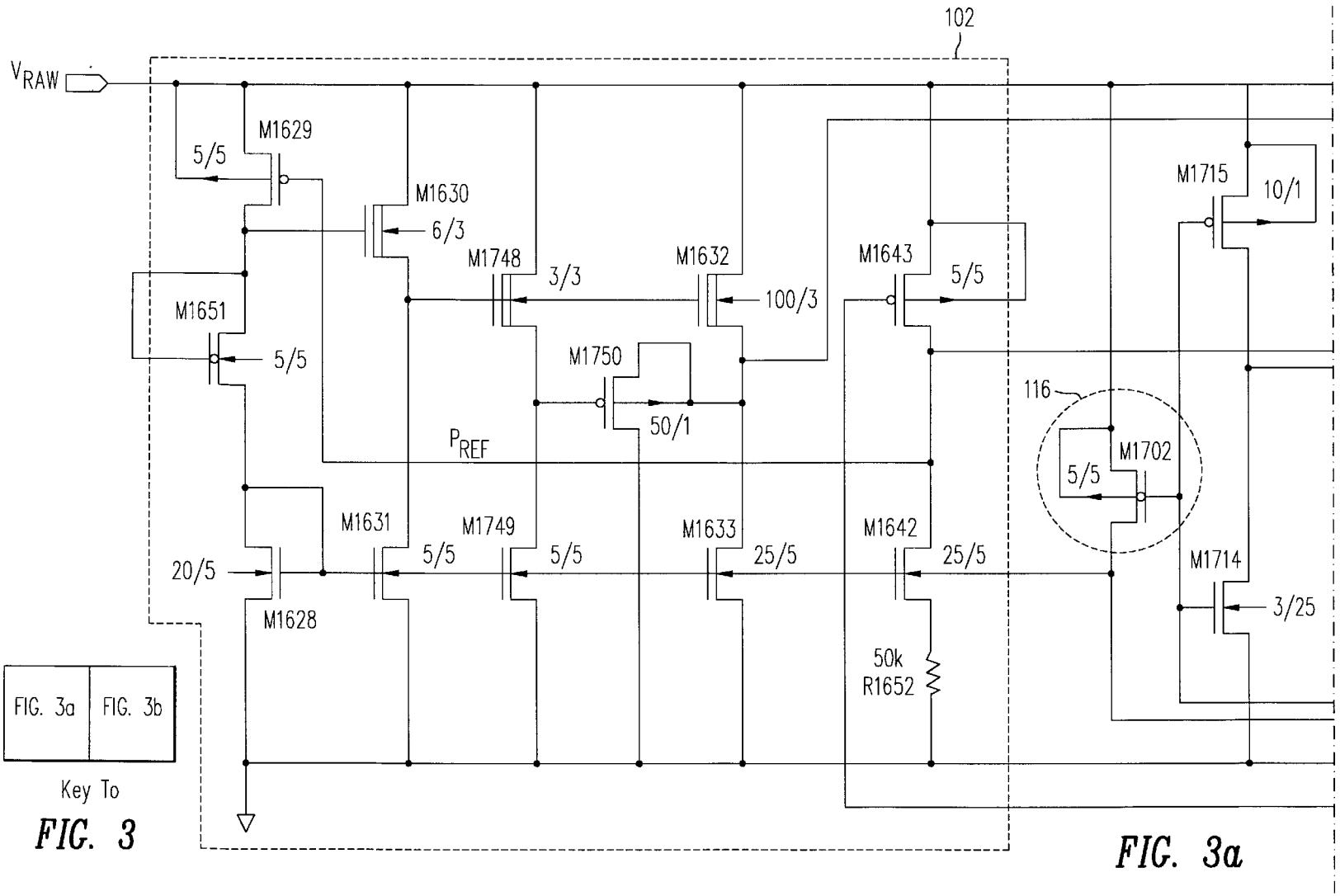
FIG. 3 shows a schematic diagram illustrating the FIG. 1 embodiment in still more detail.
Figure 3B:
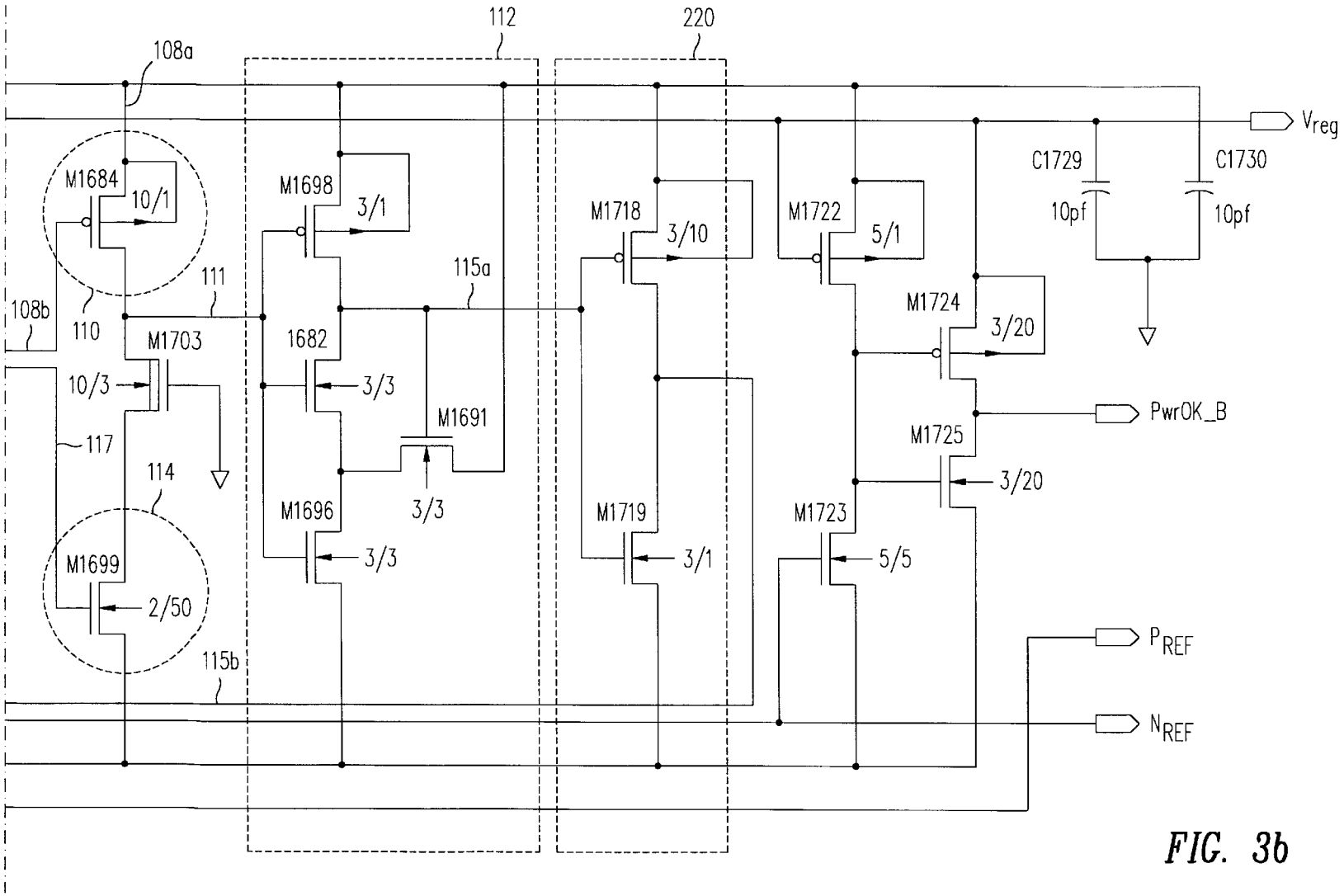

FIG. 3 shows detail of the embodiment of FIG. 2 in a complete schematic circuit diagram, again using like reference numbers to refer to like structures. FIG. 3 is similar to FIG. 1 of commonly invented Rapp U.S. Pat. No. 5,686,824, incorporated herein by reference in its entirety, and FIG. 3 shows a circuit that functions in a manner similar to those circuits described above and as described in U.S. Pat. No. 5,686,824. FIG. 3 also shows P-type and N-type enhancement and depletion mode MOSFETs using standard circuit symbols. In addition, FIG. 3 shows the relative sizes of each transistor in a conventional gate ($\mu$meter) Width/Length format. See also U.S. Pat. No. 5,686,824. $V_{RAW}$ is an unregulated supply voltage that can vary. $V_{REG}$ is a regulated voltage derived from $V_{RAW}$ by a voltage regulator. Capacitors C1729 and C1730 are filter capacitors to stabilize these voltages.

As shown, current mirror voltage reference and regulator circuit 102 receives the unregulated input supply voltage $V_{RAW}$ and supplies reference voltages $P_{Ref}$ and $N_{Ref}$ as well as a regulated voltage $V_{REG}$. $P_{Ref}$ functions as a global P-channel current mirror reference signal on line 108*b*. It also controls transistor M1684 which acts as a reference current monitor 110. Transistor M1684 conducts via transistor M1699 that acts as weak current source 114. Transistor M1703 acts as a capacitor. Transistor M1699 dimensions control current.

In this embodiment the inverting hysteresis circuit is a Schmitt inverter 112. The voltage level on line 111 is an input signal to Schmitt inverter 112 (including transistors M1698/M1682/M1696/M1691). The Schmitt inverter 112 output signal on line 115*a* is inverted by inverter 220 (transistors M1718/M1719) to produce an input signal to transistor M1702 on line 115*b*. Transistor M1702 acts as a start-up current source. Reference circuit 102 receives a start-up current when a low voltage level on line 115*b* causes transistor M1702 to conduct.

The circuit depicted in FIG. 3 operates in a manner similar to that of FIG. 2. In FIG. 3, transistors M1628, M1629, M1642, and M1643 respectively correspond to transistors 208, 204, 206, and 202 in FIG. 2. Resistor R1652 corresponds to resistor 209 in FIG. 2. The remaining transistors in block 102 comprise the voltage regulator that regulates input voltage $V_{RAW}$ to be voltage $V_{REG}$. If reference circuit 102 is in a non-conducting state, the $P_{Ref}$ voltage level on line 108*b* causes transistor M1684 not to conduct. When transistor M1684 does not conduct, transistor M1699 (weak current source 114) causes a low voltage on line 111. The line 111 low voltage input to Schmitt inverter 112 results in a high voltage output on line 115*a*, subsequently inverted by inverter 220 to low voltage on line 115*b*. Consequently transistor M1702 conducts and provides start-up current to reference circuit 102.

After reference circuit 102 reaches its designed-for conducting state, either on initial power-up or after receiving start-up current via transistor M1702, the circuit acts to remove the start-up current since it is no longer needed. $P_{Ref}$ now reflects current in reference circuit 102 to current monitor 110, causing logical voltage levels on lines 111, 115*a*, and 115*b* to go high, low, and high, respectively, and the start-up signal is canceled.

The embodiment shown in FIG. 3 also conserves power by turning off weak current source 114 (transistor M1699) when reference circuit 102 does not require a start-up pulse. It operates similarly to the FIG. 2 embodiment. As described above, when reference circuit 102 is in a conducting state, a voltage on line 115*b* will be at a logic high level. The line

115*b* voltage is inverted via the inverter which includes transistors M1714/M1715 to a logic low voltage on line 117, controlling transistor M1699.

Those skilled in the art should realize that while the above description has shown and described particular embodiments, many obvious changes and modifications may exist without departing from the invention's broader aspects. Therefore the scope of the following claims encompass all obvious changes and modifications that fall within the invention's true scope and spirit.

What is claimed is:

1. A start-up pulse generator comprising:

a bistable reference circuit having an input terminal and an output terminal, and which outputs at said output terminal a first voltage level in a first steady state and a second voltage level in a second steady state;

a monitor having an input terminal coupled to said reference circuit output terminal, and which outputs at an output terminal a first output signal upon receipt of said first voltage level and a second output signal upon receipt of said second voltage level;

a hysteresis circuit having an input terminal coupled to said monitor output terminal, and an output terminal; and a start-up signal generator having an input terminal coupled to said hysteresis circuit output terminal, and an output terminal coupled to said reference circuit input terminal, and which provides a start-up signal to said reference circuit upon receipt of said first output signal.

2. The apparatus of claim 1 wherein said start-up signal generator does not provide said startup signal to said reference circuit upon receipt of said second output signal.

3. The apparatus of claim 1 wherein said reference circuit comprises a current mirror reference circuit, and said reference circuit output terminal is a node in said current mirror reference circuit.

4. The apparatus of claim 1, wherein said monitor is a current monitor and said start-up signal generator generates a current.

5. The apparatus of claim 1 wherein said hysteresis circuit comprises a Schmitt inverter.

6. The apparatus of claim 1 further comprising a current source having a control terminal, a first terminal, and a second terminal, wherein an electrical condition at said current source control terminal controls current flow between said current source first and second terminals, said current source control terminal being coupled to said hysteresis circuit output terminal, said first terminal being coupled to said reference circuit, and said second terminal being coupled to a reference voltage;

wherein said current source is non-conducting when said bistable reference circuit outputs said second voltage level.

7. The apparatus of claim 6 wherein said hysteresis circuit comprises a Schmitt inverter.

8. A method of generating a self-canceling start-up pulse comprising:

monitoring a signal level in a bistable reference circuit;

providing via a hysteresis circuit a current to said reference circuit when said signal level is within a first predetermined range;

using said current to force said bistable reference circuit into a first steady state; and removing said current when said signal level is within a second predetermined range.

9. The method of claim 8, wherein said hysteresis circuit comprises a Schmitt inverter.

10. The method of claim 8, wherein said monitoring monitors a voltage level in said reference circuit.

* * * * *